US006781297B2

(12) United States Patent
LaPeruta, Jr. et al.

(10) Patent No.: US 6,781,297 B2
(45) Date of Patent: Aug. 24, 2004

(54) METHOD AND APPARATUS FOR MAINTAINING MASK STRAND SPATIAL UNIFORMITY

(75) Inventors: Richard LaPeruta, Jr., Lititz, PA (US); Edward Richard Garrity, Jr., Lancaster, PA (US)

(73) Assignee: Thomson Licensing S. A., Boulogne-Billancourt (FR)

( * ) Notice: Subject to any disclaimer, the term of this patent is extended or adjusted under 35 U.S.C. 154(b) by 64 days.

(21) Appl. No.: 09/827,720

(22) Filed: Apr. 7, 2001

(65) Prior Publication Data

US 2002/0145375 A1 Oct. 10, 2002

(51) Int. Cl.[7] ..... H01J 29/07; H01J 09/00

(52) U.S. Cl. ..... 313/402; 313/404; 313/407; 445/37; 445/47

(58) Field of Search ..... 313/402, 404, 313/407; 445/30, 37, 47; 29/896.6, 896.67

(56) References Cited

U.S. PATENT DOCUMENTS

| | | | | | |
|---|---|---|---|---|---|
| 4,857,027 | A | * | 8/1989 | Makita et al. | 445/37 |
| 5,085,606 | A | | 2/1992 | Kaplan et al. | 445/30 |
| 5,111,106 | A | * | 5/1992 | Kaplan et al. | 313/403 |
| 5,406,168 | A | * | 4/1995 | Takagi | 313/402 |
| 5,613,889 | A | * | 3/1997 | Nosker et al. | 445/37 |
| 6,111,347 | A | * | 8/2000 | Kwak | 313/402 |
| 6,111,349 | A | * | 8/2000 | Kuwana et al. | 313/407 |

FOREIGN PATENT DOCUMENTS

| | | | |
|---|---|---|---|
| GB | 2 308 223 A | 6/1997 | H01J/9/14 |
| WO | WO 97/05643 | 2/1997 | H01J/29/07 |
| WO | WO 00/22644 | 4/2000 | H01J/29/07 |
| WO | WO 00/60638 | 10/2000 | H01J/29/07 |
| WO | WO 00/62323 | 10/2000 | H01J/29/07 |
| WO | WO 02/50862 A2 | 6/2002 | H01J/31/20 |

* cited by examiner

*Primary Examiner*—Ashok Patel
(74) *Attorney, Agent, or Firm*—Joseph S. Tripoli; Joseph J. Laks; Carlos M. Herrera

(57) ABSTRACT

A method and apparatus of maintaining spacing between tension mask strands in a tension mask. The method includes providing a tension mask with strands connecting therebetween and attaching a set of barrier ridge elements to a first side of the strands. Next, the tension mask is tensioned and affixed to a mask frame to form a mask frame assembly.

12 Claims, 4 Drawing Sheets

METHOD AND APPARATUS FOR MAINTAINING MASK STRAND SPATIAL UNIFORMITY

This invention generally relates to color picture tubes and, more particularly, a method and apparatus for fabricating tension masks for color picture tubes.

BACKGROUND OF THE INVENTION

A color picture tube includes an electron gun for forming and directing three electron beams to a screen of the tube. The screen is located on the inner surface of the faceplate of the tube and is made up of an array of elements of three different color emitting phosphors. An aperture mask, which may be either a domed mask or a tension mask, is interposed between the gun and the screen to permit each electron beam to strike only the phosphor elements associated with that beam. A mask is a thin sheet of metal, such as steel, that is contoured to somewhat parallel the inner surface of the tube faceplate. A focus mask comprises two sets of conductive lines that are perpendicular to each other and separated by an insulator. When different potentials are applied to the two sets of lines to create multiple focusing lenses in each of the mask openings, the mask is referred to as a focus mask. One type of focus mask is a tension focus mask, wherein at least one of the sets of conductive lines is under tension. Generally, in a tension focus mask, a vertical set of conductive lines or strands is under tension and a horizontal set of conductive lines or wires overlies the strands.

In assembling a strand tension mask, it is required to assemble the strands with a high degree of accuracy to achieve consistent spacing between the strands.

SUMMARY OF THE INVENTION

The present invention provides a method and apparatus for maintaining uniform spacing between the strands of a tension mask frame. The apparatus includes providing a set of barrier ridges and affixing them to a tension mask. The barrier ridge is aligned perpendicular to the strands of the tension mask and affixed to the frame near the ends of the tension mask. The barrier ridges traverse the length of the tension mask and act to keep the mask strands parallel and equidistantly spaced from each other when faced with applied stress during mask welding and subsequent thermal processing. After the barrier ridges are affixed to the frame. The tension mask is mounted to the mask frame. The barrier ridges are affixed to the frame inside the frame and directly under and in contract with the mask strands. When the tension mask is mounted to the mask frame, the barrier ridges lay inside the mask frame, and between the mask frame and the array region of the tension mask that produces visible image on the screen. The mask strands are in frictional contact with the barrier ridge. They may also be adhered to the ridge by a suitable adhesive such as one sold under the trademark KASIL™ containing potassium silicate.

During mask-to-frame welding, mask strands are welded directly to the cantilever of the frame. Because of the frictional force exerted by the barrier ridge, mechanical stresses applied to strands along the weld contact points are isolated to the regions of the strands of the contact points. Therefore, the portions of the strands between the barrier ridges are, advantageously, less affected by the mechanical stresses and maintain their positions. After the tension mask is affixed to the mask frame, the entire mask frame assembly is used in manufacturing a color picture tube. As such, the assembly is processed through a series of thermal cycles. The barrier ridges expand and contract in unison with the mask frame. By attaching the tension mask strands to the barrier ridges, spatial integrity between the strands is thus maintained during the manufacturing of the strand tension masks, subsequent processing and tube operation.

DETAILED DESCRIPTION

Figure 1:
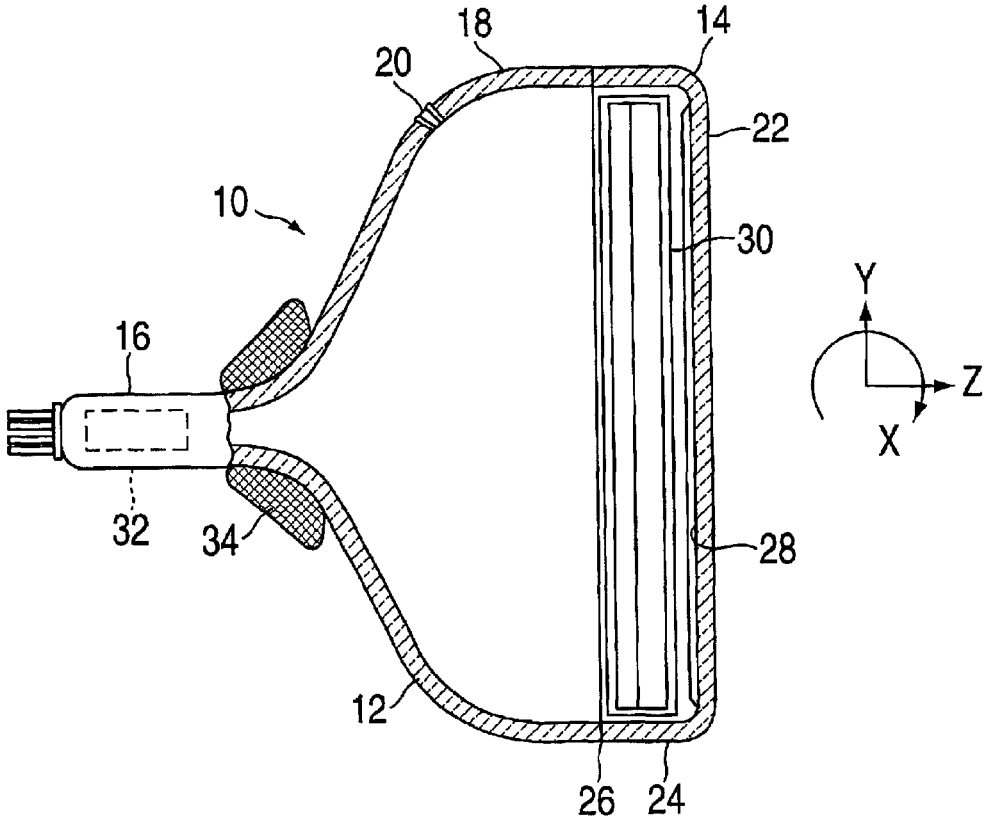
FIG. 1 is a side view, partially in the axial section, of a color picture tube, including a strand tension focus mask-frame-assembly according to the present invention.

FIG. 1 shows a cathode ray tube 10 having a glass envelope 12 comprises a rectangular faceplate panel 14 and a tubular neck 16 connected by a rectangular funnel 18. The funnel 18 has an internal conductive coating (not shown) that extends from an anode button 20 to a neck 16. The panel 14 comprises a viewing faceplate 22 and a peripheral flange or sidewall 24 that is sealed to the funnel 18 by a glass sealing frit 26. A three-color phosphor screen 28 is carried by the inner surface of the faceplate 22. The screen 28 is a line screen with the phosphor lines arranged in triads, each triad including a phosphor line of each of the three colors. A cylindrical tension mask assembly 30 is removably mounted in a predetermined spaced relation to the screen 28. The mask may be either a tension focus mask or a tension mask. An electron gun 32 (schematically shown by the dashed lines in FIG. 1) is centrally mounted within the neck 16 to generate three in-line electron beams, a center beam and two side beams, along convergent paths through the mask assembly 30 to the screen 28.

The tube 10 is designed to be used with an external magnetic deflection yoke, such as the yoke 34 shown in the neighborhood of the funnel to neck junction. When activated, the yoke 34 subjects the three beams to magnetic fields that cause the beams to scan horizontally and vertically in a rectangular raster over the screen 28.

Figure 2:
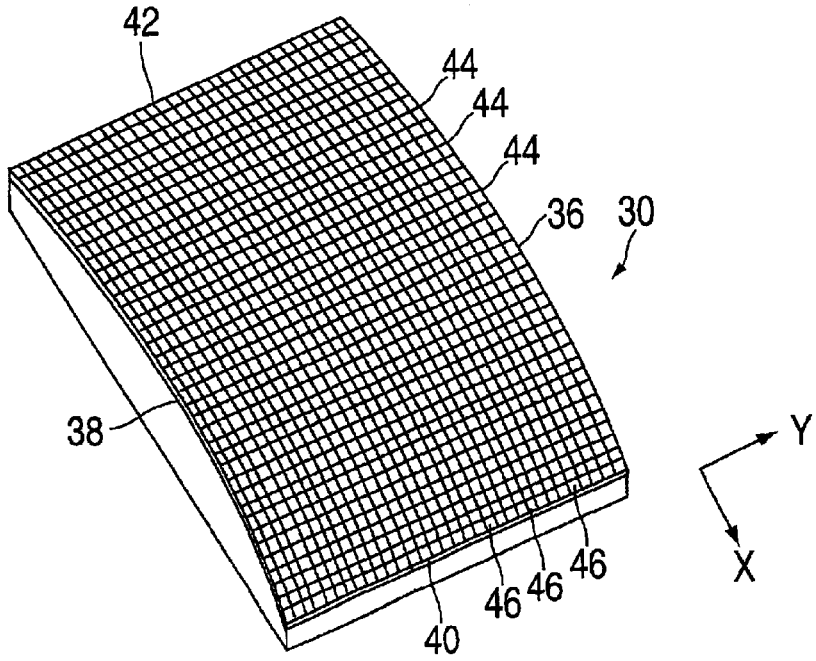
FIG. 2 is a perspective view of the strand tension focus mask-frame-assembly of FIG. 1.

A strand tension focus mask assembly 30, shown in greater detail in FIG. 2, includes two tong sides 36 and 38 and two short sides 40 and 42. The two long sides 36 and 38 of the mask assembly parallel a central major axis, x, of the tube. The tension mask assembly 30 includes two sets of conductive lines: strands 44 that are parallel to the central minor axis y and to each other; and crosswires 46, that are parallel to the central major axis x and to each other. The crosswires 46 are coupled to busbars (not shown) on their distal ends and lie above the mask strands. In one embodiment, the strands 44 are flat strips that extend vertically, having a width of about 13 mils and a thickness of about 2 mils, and the crosswires 46 have a round cross section, having a diameter of approximately 1 mil and extend horizontally. In the completed mask, the strands 44 and crosswires 46 are separated from each other by a suitable insulator such as lead frit.

Figure 3:
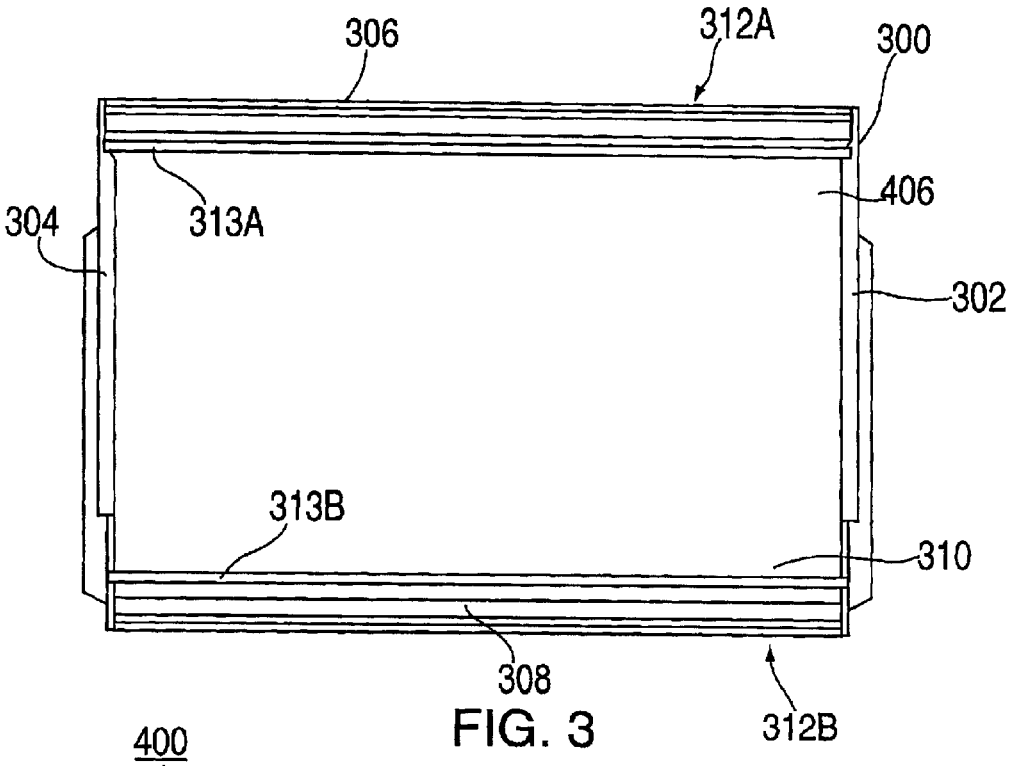
FIG. 3 is a front view of a tension mask frame of FIG. 2 prior to attachment of the strand tension mask.
Figure 4:
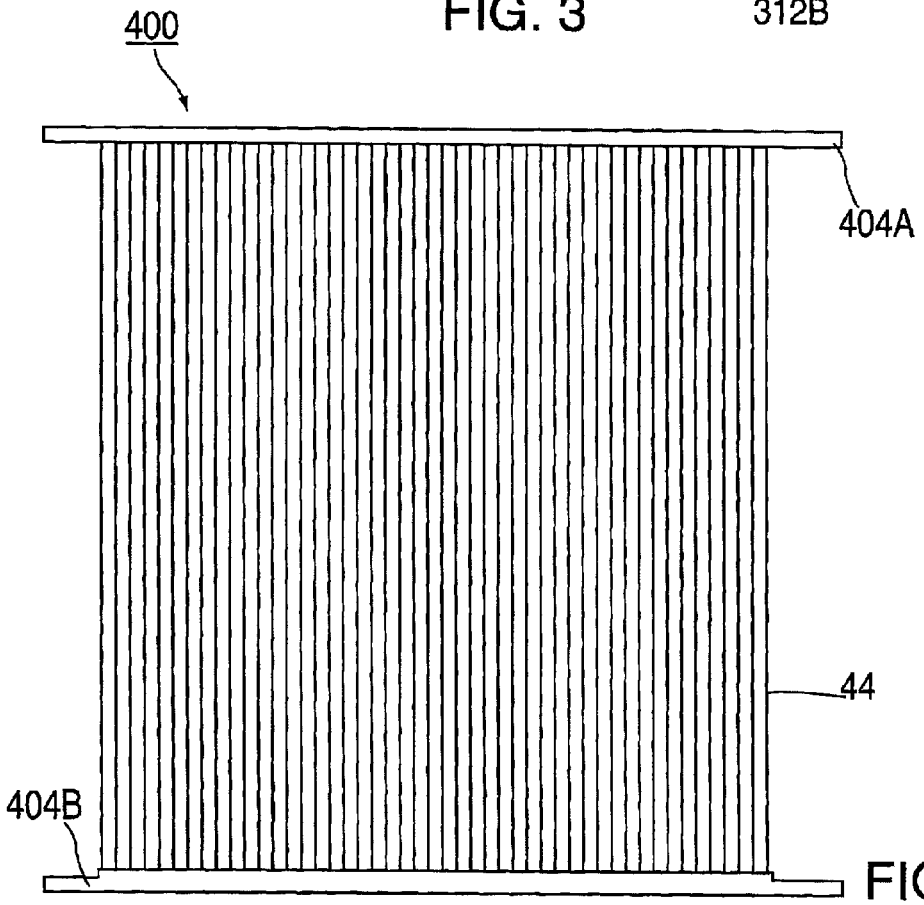
FIG. 4 is a front view of the strand tension mask of FIG. 2 prior to welding to the tension mask frame.
Figure 6:
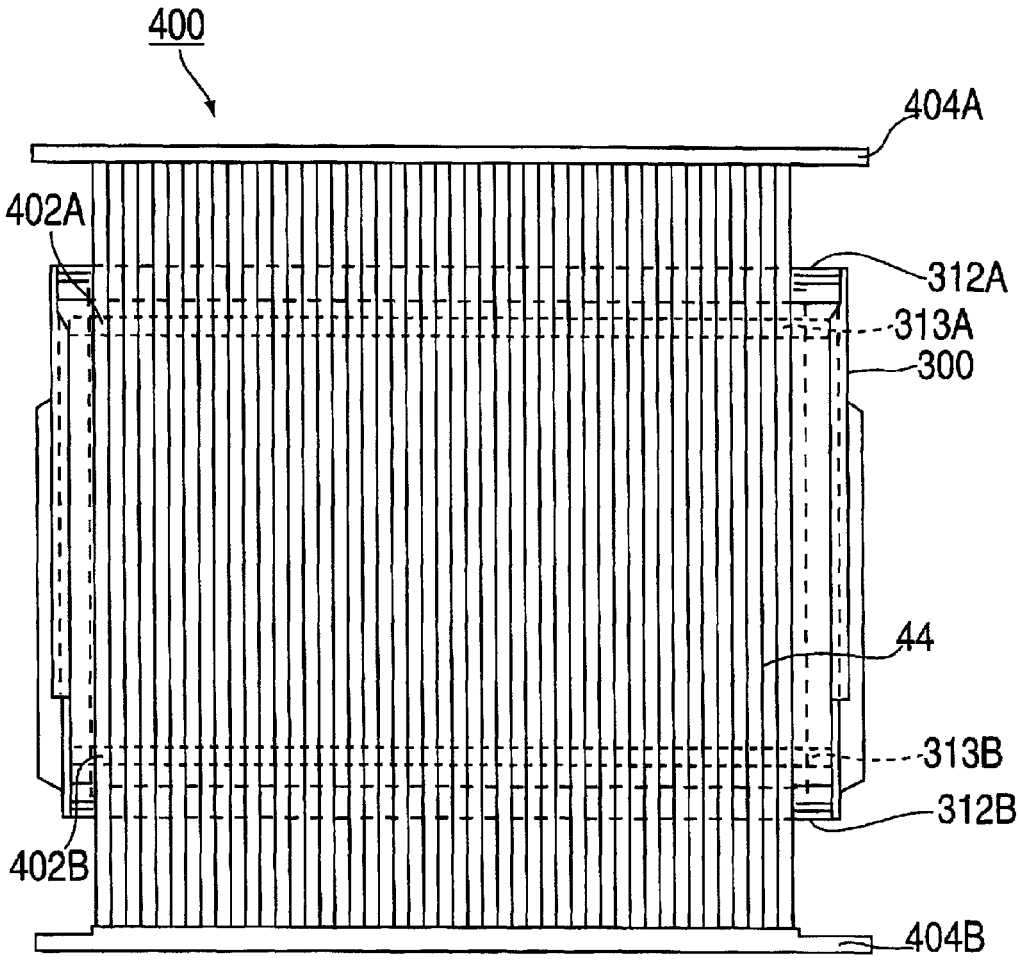
FIG. 6 is a front view of the tension mask assembly according to the present invention; this drawing illustrates the relationship between the locations of the mask frame, the barrier ridges and the mask skirt.

FIG. 3 is a front view of a mask frame 300 similar to that of FIG. 2. The mask frame 300 is comprised of a set of segments attached together to form a generally rectangular shape. Segments 302 and 304 represent the vertical elements of the mask frame 300. The mask frame 300 also includes horizontal segments 306 and 308. Element 310 is a representation of an aperture formed inside the mask frame 300. Cantilevers 312A and 312B are outer portions of the mask frame 300. These cantilevers 312A and 312B are the areas to which strands 44 of stand alone tension mask 400 of FIG. 4 are welded. Barrier ridges 313A and 313B shown in FIG. 3, are attached to the mask frame 300 and help to make up part of the horizontal segments 306 and 308. FIG. 6 represents how a tension mask 400 is generally affixed to a mask frame 300.

Figure 5:
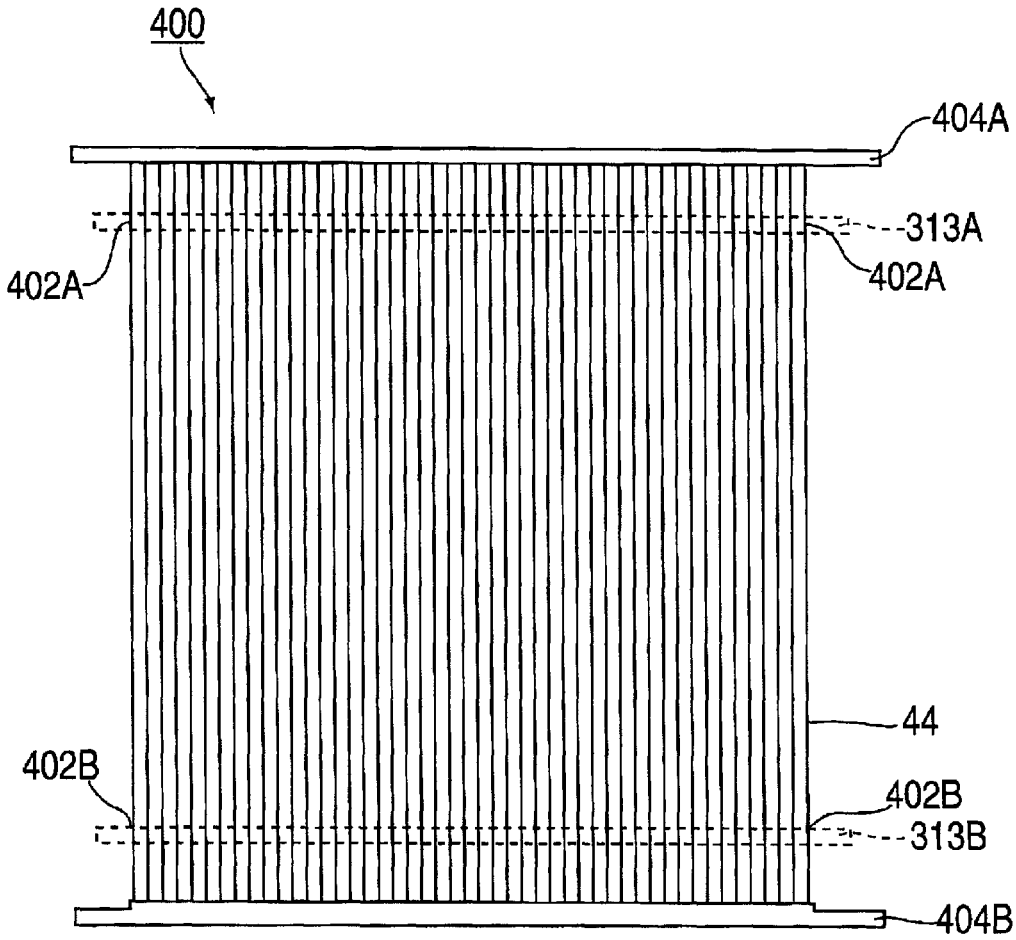
FIG. 5 is a front view of a tension mask of FIG. 4 depicting the locations of the tension mask which will contact the barrier ridges on the mask frame.

FIG. 4 is a front view of the stand alone tension mask 400 that is used, when assembled, in the arrangement of FIG. 2. The free tension mask 400 is formed of a flat thin sheet of material that has been etched to form a plurality of strands 44 between two edge portions 404A and 404B. Edges 404A and 404B are used for handling purposes prior to mask frame welding and are removed or severed afterward. FIG. 5 is a front view of the tension mask 400 of FIG. 4, depicting the locations of attachment points 402A and 402B of the free tension mask 400 which will be in frictional contact with the barrier ridges 313A and 313B. The barrier ridge elements 313A and 313B are aligned (as discussed below) generally perpendicularly to the mask strands 44. Next, FIG. 6 is a front view of the tension mask assembly according to the present invention; this drawing illustrates the relationship between the locations of the mask frame 300, the barrier ridge elements 313A and 313B, the mask edge portions 404A and 404B and the locations of attachment points 402A and 402B prior to severing the borders 404A and 404B.

To best understand the invention, the reader should simultaneously refer to FIGS. 3, 4, 5 and 6. The mask aperture area, or viewable array region, 406 in which the mask strands 44 traverse, is an area in which it is essential for mask strands 44 to maintain proper spatial integrity in relation to the mask frame 300 during assembly of the mask frame assembly 30 and the picture tube 10. If proper spatial integrity is not maintained between the individual mask strands 44 and the mask frame 300, the electron beam is caused to misregister, relative to its intended phosphor target, thus creating a visible optical anomaly on the phosor screen 28, typically affecting color purity or causing visible streaks. It is therefore desirable to maintain parallel and uniform spacing between the mask strands 44. Commonly used mask frame 300 materials include but are not limited to steel alloys or iron-nickel alloys.

As mentioned above, the free tension mask 400 is formed of a flat thin sheet of material that has been etched to form a plurality of strands 44 between two edge portions 404. Each strand 44 is substantially parallel to the other, and each strand 44 is spaced at a precise distance apart from the other. The material of the free tension mask 400 is formed of is generally a steel or an iron nickel alloy.

Direct welding of each of mask strands 44 to the cantilevers 312A and 312B is necessary in that it allows each individual mask strand 44 to be isolated from the other mask strands 44 during tube fabrication and operation. The barrier ridges 313A and 313B to which the mask strands 44 are in frictional contact isolate each mask strand 44 from other mask strands 44 during the welding of the mask strands 44 to the cantilevers 312A and 312B.

FIG. 5 is a rear view of the tension mask 400 of FIG. 4, depicting the locations of attachment points 402A and 402B of the free tension mask 400 barrier ridges 313A and 313B of the present invention. The mask strands 44 are attached perpendicularly to the barrier ridges 313A and 313B as mentioned above. The barrier ridges are mechanical components of the mask frame 300. The barrier ridges 313A and 313B as well as the cantilevers 312A and 312B have accurate contours.

The barrier ridges 313A and 313B to which the mask strands 44 contact prevent the mask strands in the area of the barrier ridges 313A and 313B from losing spatial integrity in relation to each other and to the mask frame 300. The friction between mask strands 44 and barrier ridge 313A or 313B prohibits mask strands 44 from moving laterally, during the welding process of mask strands 44 to cantilever 312A or 312B, respectively. Strands 44 may be added to barrier ridges 313A and 313B using suitable adhesive such as Silicate glass for further prohibiting the lateral movement of strands 44.

FIG. 6 is a top view of the tension mask assembly 30 according to the present invention; this drawing illustrates the relationship between the locations of the mask frame 300, the barrier ridges 313A and 313B and the mask edge portions 404A and 404B. The free tension mask 400 is inserted into, and placed under tension, by a stretching fixture (not shown). The tension created by the stretching fixture maintains the spatial integrity of the mask strands 44. The tension mask 400 is then laid across and brought into contact with the mask frame 300. At this point, the locations or attachment points 402A and 402B of the free tension mask 400 contact the barrier ridges 313A and 313B.

The strands 44 are then attached to the cantilevers 312A and 312B by welding or other attachment method. The method of welding the strands 44 to the mask frame 300 is accomplished by, but not limited to, seam, resistance, spot, laser, and tack welding. After the mask strands 44 have been affixed to the cantilevers 312A and 312B, the entire mask frame assembly 30 is prepared for further processing.

As the embodiments that incorporate the teachings of the present invention have been shown and described in detail, those skilled in the art can readily devise many other varied embodiments that still incorporate these teachings without departing from the spirit of the invention.

What is claimed is:

1. A tension mask assembly for a cathode ray tube having a screen and an electron gun, said tension mask assembly disposed between said screen and said electron gun and comprising:

a mask frame including a first pair of frame members disposed at opposite ends, respectively, of said mask frame;

a plurality of mask strands disposed between said first pair of frame members and affixed to said pair of frame members in a manner to produce tension in said mask strands; and a third member for supporting said plurality of mask strands in a first intermediate region of said mask strands, between said pair of frame members, wherein said third member extends from an electron gun facing side toward said screen to contact said first intermediate region of said mask strands, said third member is attached to said mask strands by an adhesive.

2. A tension mask assembly according to claim 1, wherein said third member is disposed in a direction parallel to a direction of one of said pair of frame members and closer to said one of said pair of frame members than to the other one of said pair of frame members.

3. A tension mask assembly according to claim 2, further comprising a fourth member for supporting said plurality of mask strands in a second intermediate region of said mask strands, between said pair of frame members.

4. A tension mask assembly according to claim 1, wherein said mask strands are made of an etched strand material.

5. A tension mask assembly according to claim 1, wherein, in a stand alone state, said plurality of mask strands are connected to each other with an unetched strand material on each end.

6. A tension mask assembly according to claim 1, wherein said third member is disposed perpendicularly to said mask strands.

7. A tension mask assembly according to claim 1, wherein a second pair of frame members are affixed to said first pair of frame members to form said mask frame having a rectangular shape.

8. A tension mask assembly according to claim 3, wherein said third member and said fourth member apply a frictional force to said mask strands.

9. A method for forming a tension mask assembly in a cathode ray tube having a screen and an electron gun, comprising the steps of (a) providing a tension mask with a plurality of etched mask strands disposed vertically between two respective end regions;

(b) placing the etched mask strands in contact with a plurality of barrier ridge elements to the tension mask;

(c) affixing the tension mask to a mask frame having vertical and horizontal elements, wherein the barrier ridge elements extend from an electron gun facing side of the tension mask to contact the tension; and (d) affixing the etched mask strands to the plurality of barrier ridge segments with an adhesive.

10. The method of claim 9, further comprising the step of trimming the mask strands flush to the outer portion of a mask frame assembly after the mask strands are affixed to the mask frame.

11. The method of claim 9, further comprising the step of aligning the barrier ridge elements perpendicular to the mask strands.

12. The method of claim 9, further comprising the step of aligning the mask strands and the barrier ridge elements such that the mask strands are perpendicular to the horizontal elements of the mask frame end the barrier ridge elements.

* * * * *